US005984277A

United States Patent [19]

Kanzler et al.

[11] Patent Number: 5,984,277

[45] Date of Patent: Nov. 16, 1999

[54] METHOD OF OPERATING A WINCH, AND ASSOCIATED DEVICE

[75] Inventors: Helmut Kanzler, Vöhringen; Alfons Rock, Elchingen; Gerhard Ummenhofer, Bad Schussenried, all of Germany

[73] Assignee: Kaessbohrer Gelaendefahrzeug GmbH, Germany

[21] Appl. No.: 08/987,285

[22] Filed: Dec. 10, 1997

[30] Foreign Application Priority Data

Dec. 27, 1996 [DE] Germany ..... 196 54 547

[51] Int. Cl.[6] ..... B66D 1/08

[52] U.S. Cl. ..... 254/361; 254/291; 254/377; 254/382; 60/436; 60/486

[58] Field of Search ..... 254/361, 291, 254/379, 377, 382; 60/436, 425, 486

[56] References Cited

U.S. PATENT DOCUMENTS

| | | | |
|---|---|---|---|
| 2,986,884 | 6/1961 | Smith | 60/436 X |
| 3,037,720 | 6/1962 | Leithiser, Jr. | 254/291 X |
| 3,388,890 | 6/1968 | Born et al. | 254/361 X |
| 3,448,962 | 6/1969 | Miller | 254/291 |
| 3,668,973 | 6/1972 | Kado et al. | 60/436 X |
| 3,768,263 | 10/1973 | Olson et al. | 60/425 |
| 3,788,605 | 1/1974 | Johnson | 254/361 |
| 4,188,790 | 2/1980 | Pedersen | 60/486 X |
| 4,218,883 | 8/1980 | Pedersen | 60/486 X |
| 4,223,871 | 9/1980 | Braithwaite | 254/291 |
| 4,234,167 | 11/1980 | Lane | 254/291 |
| 4,921,219 | 5/1990 | Ottemann et al. | 254/291 X |

FOREIGN PATENT DOCUMENTS

| | | | |
|---|---|---|---|
| 0 719 726 A1 | 7/1996 | European Pat. Off. . | |
| 1 809 441 | 11/1968 | Germany . | |
| 2102728 | 7/1971 | Germany | 254/291 |

*Primary Examiner*—Donald P. Walsh
*Assistant Examiner*—Minh-Chau Pham
*Attorney, Agent, or Firm*—Samuels, Gauthier & Stevens

[57] ABSTRACT

The present invention relates to a method of operating a winch, in which a rope which is wound onto a driven reel is supplied to at least one capstan head and wound around said capstan head, with a capstan drive rotating the capstan head and producing a rope advance due to the rope friction existing between rope and capstan head. Moreover, the present invention relates to a corresponding device. As an improvement of the method and the device, the invention suggests a reel drive which is adjusted separately next to the capstan drive.

22 Claims, 5 Drawing Sheets

METHOD OF OPERATING A WINCH, AND ASSOCIATED DEVICE

BACKGROUND OF THE INVENTION

1. Field of the Invention

The present invention relates to a method of operating a winch, in which a rope which is wound onto a driven reel is supplied to at least one capstan head and is wound around said capstan head, with a capstan drive rotating the capstan head and producing a rope advance due to the rope friction existing between rope and capstan head. Furthermore, the present invention relates to a corresponding winch.

2. Description of the Prior Art

Winches of this type are, for instance, used in piste maintaining devices as climbing aids for climbing steep pistes. The rope is wound around the capstan head or capstan heads once or several times and is hauled in by the reel drum. The vehicle is advanced by rotating the capstan head due to the static friction produced by the rope being wound around the capstan heads.

In a winch which is known in practice, the reel and the capstan head are each provided with a hydraulic motor which is driven by a joint hydraulic pump. This ensures that, when the capstan head is driven, the rope is continuously received from the reel and the necessary winding around the capstan head is simultaneously maintained. In practice, however, problems have arisen from the reel winding. The rope is very tightly wound onto the reel, and it may happen that the rope gets pinched between two windings of a lower rope layer when being wound up. Moreover, there is the risk that the rope will not properly travel in the axial direction of the reel, but is wound in an untidy manner as a bulging portion onto a reel section.

It is the object of the present invention to improve the generic method, as well as the winch associated therewith, in such a manner that the rope can be wound without any problems onto the reel and that an effective rope advance for a good drive is made possible by the winch at the same time, the winch being operable in a manner which is as simple and reliable as possible.

This object is achieved according to the invention with a generic method which is characterized in that the reel drive is adjusted separately next to the capstan drive.

As a consequence, the reel drive can be better optimized to the function of winding and unwinding the rope, so that the rope can be received on a reel without any problem. Apart from this, the capstan drive can be optimized in accordance with the required tractive power or advance power of the vehicle. The reel drive ensures an adequate rope tension for maintaining the winding around the capstan head as is required for the advance movement.

Surprisingly enough, it has been found in practice that a tidy winding onto the reel is possible thanks to this section-wise separation of the drives. Moreover, this improves efficiency, since power losses between capstan head and reel are minimized thanks to the separate adjustment and thanks to a possible improved adaptation of the members.

While it has so far been assumed throughout the prior art that the drives of reel and capstan head must be intregrally formed and adjusted to achieve an optimum cooperation of the two elements, the present invention shows an approach in which use is made of separate adjustments or controls and an improved cooperation of the elements is nevertheless possible.

In an especially advantageous manner the reel can be driven in accordance with the necessary tensile force of the rope between reel and capstan head. This results in the achievement of an optimum tractive force between capstan head and reel. The tractive force can be adapted such that there is enough static friction for the advance movement on the capstan head and enough traction for an orderly winding of the rope onto the reel. The tensile force, however, can be kept below a critical range which, if exceeded, would result in problems with the winding. The tensile force, for instance, may be at about 700 N, which is a suitable value for winches of piste maintaining devices.

The displacement volume of a hydraulic pump which is connected to a hydraulic motor driving the reel can be adjusted in a specific manner in response to the load condition of the hydraulic motor. As a result, the drive of the reel can very well be optimized for an optimum tensile force of the rope between reel and capstan head. When the force of the rope increases excessively, the displacement volume can be reduced, so that the tensile force will no longer increase. In the case of a slack rope the displacement volume can be increased, so that the rope is wound up rapidly and up to an optimum tension. The load condition of the hydraulic motor respectively results from the resistance transmitted by the reel drum to the motor. With the aid of the hydraulic pump the drive of the hydraulic motor can be adjusted or controlled in an optimum manner by a corresponding adjustment.

Preferably, the load pressure can be kept substantially constant under different load conditions in a hydraulic line which is provided between a hydraulic motor driving the reel and the hydraulic pump driving the motor. The drive power can very well be controlled by this measure. At the same time, this measure prevents the occurrence of excessive torques on the reel. The drive power can very well be varied in the hydraulic pump just by adjusting the displacement volume.

In a variant of the invention, the control circuit of the reel drive can be activated separately. This is especially of advantage when the system is started, since the adjustment or control need only be activated upon start of the rope operation. Prior to this activation a low standby pressure could, for instance, be set in the reel system. It is only upon the winch operation proper that a control operation with the necessary operative pressure for ensuring the necessary minimum torques can be started by activating the reel drive.

A motor of the reel drive might be operated as a resistance-producing pump when the rope is being pulled from the reel. When the rope is being pulled, this ensures a sufficient counter-force which will slightly tighten the rope and supply the sane to the capstan head.

In a special embodiment, the capstan drive can be controlled independently of the reel drive according to the necessary rope advance. As a result, the desired drive force or drive speed of the capstan drive can be controlled separately, so that the reel drive need not be taken into account. Hence, it adjusts automatically. As a consequence, upon operation of the winch drive, the advance movement can be concentrated on.

It is possible to change the displacement volume of a hydraulic pump with the aid of and under separate control of the load pressure produced by the hydraulic pump, with the latter being connected to the hydraulic motor driving the capstan head. Hence, the load pressure can be used for controlling the pump. The load pressure can then be varied accordingly in a branch line and can be made use of in a correspondingly controlling manner for adjusting the said pump.

A reel brake and a capstan head brake can especially advantageously be released at the same time when the winch drive is started. Hence, reel and capstan head are locked in the inoperative state by the brakes and they are only released upon start of the winch drive, with the corresponding torques starting the rope advance and the rope winding action at the same time. When the winch drive is stopped, both brakes, for instance, can lock again, so that the rope will remain taught between capstan head and reel in an optimum manner for the next use.

In a variant of the invention, the brakes can be operated in response to an operative pressure in a hydraulic line of the reel drive. The brakes can only be released optionally if an operative pressure in the reel drive has been exceeded, so that the reel will only be released if enough torques are already present at the reel drive for maintaining the rope tension. The operative pressure serves as a regulating means for a sufficient torque. On the other hand, the reel brake or also the capstan head brake will lock again when an operative pressure is not reached, so that the rope is kept in its taught state.

Possibly, the brakes can only be released after a torque has been applied to the reel. As a consequence, the reel drum is released and a suitable torque for the winding action and for the rope tension is already available at the time of release.

When rope and reel are replaced, a reel brake may be released in a special manner by actuating means which are separated from the drive. Therefore, even if the drive or the vehicle is at a standstill, the reel can be released from the outside for changing the rope.

In a preferred embodiment the capstan drive may be blocked during change of the rope. This ensures that the rope advance is at a standstill when the rope is being replaced.

The above-described generic method can, for instance, be realized by a generic winch which comprises a reel which is driven by a reel drive and onto which the rope can be wound and from which the rope can be unwound, with the rope being adapted to be supplied from the reel to at least one capstan head and being adapted to be wound around said head, and a capstan drive rotating the capstan head and advancing the rope because of rope friction with the capstan head.

The above-mentioned object arises in such a generic winch.

SUMMARY OF THE INVENTION

This object is achieved according to the invention by a generic winch which is characterized in that the reel drive is provided separately next to the capstan drive and is adjustable independently thereof.

Apart from the advantages as described above in connection with the method, this permits an optimum design of the reel drive for the reel winding and tensioning function.

Preferably, reel and capstan head can be driven hydraulically, with the reel comprising a driving reel motor having a reel pump of its own and the capstan head comprising a driving capstan motor of its own with a separate capstan pump. Hence, the two hydraulic circuits with motor and pump can each optimally be designed for the desired purpose. This will also simplify the constructional design of the elements, since they can be chosen for the respectively intended use. Pump and hydraulic motor c an be chosen optionally according to the necessary pressures and volume flows.

The reel pump is possibly adjustable, with the adjusting device of the pump being motionally coupled with a control circuit that reacts in response to the load condition of the reel motor. With this arrangement the reel pump can be adjusted according to the load condition of the reel motor, so that the necessary rope tension or torque, respectively, will have a controlling effect on the reel pump. The displacement volume, for instance, can be adjusted accordingly.

The control circuit can possibly be activated via a switch. As a consequence, the control can optionally be activated, if necessary, for instance, when the capstan drive is operated.

The load pressure can optionally be kept substantially constant in a high-pressure line provided between reel pump and reel motor.

The capstan pump may be adjustable in a particularly advantageous manner, with the adjusting actuator of the pump being motionally coupled with a control circuit which is separately controllable from the outside. The displacement volume of the capstan pump can be adjusted via the separate control device, so that the capstan drive is adjusted accordingly.

In a preferred embodiment a reel brake and a capstan brake may be provided for.

Reel brake and capstan brake may be jointly releasable in a specific manner. They can be released if there are enough drive torques for capstan head and reel, respectively, for the advance movement and for the tensioning and winding forces.

In a variant of the invention, the brakes may be releasable in response to an operative pressure in a hydraulic line of the reel drive. Therefore, the brakes can be released when there are enough torques and tension for the reel.

The reel brake is possibly connected to actuating means separated from the drive and is separately releasable. As a result, even if the vehicle and the drive are at a standstill, the reel brake can be released for performing maintenance work, for instance, for changing a rope.

An embodiment of the present invention is shown in the drawing and will be explained hereinafter.

DESCRIPTION OF THE PREFERRED EMBODIMENT

Figure 1:
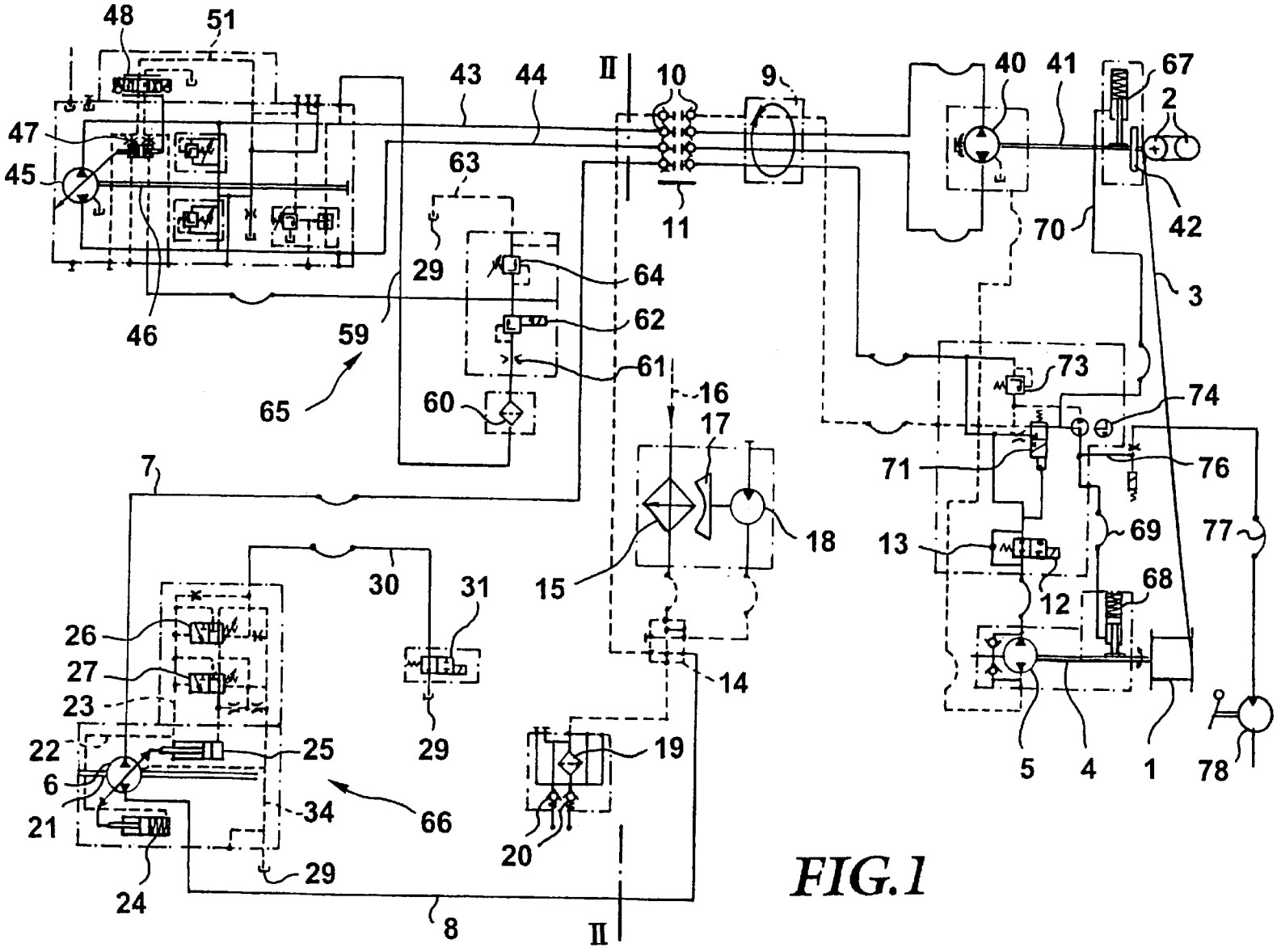
FIG. 1 shows a hydraulic circuit diagram of a winch drive for a winch according to the invention for performing the method of the invention.
Figure 2:
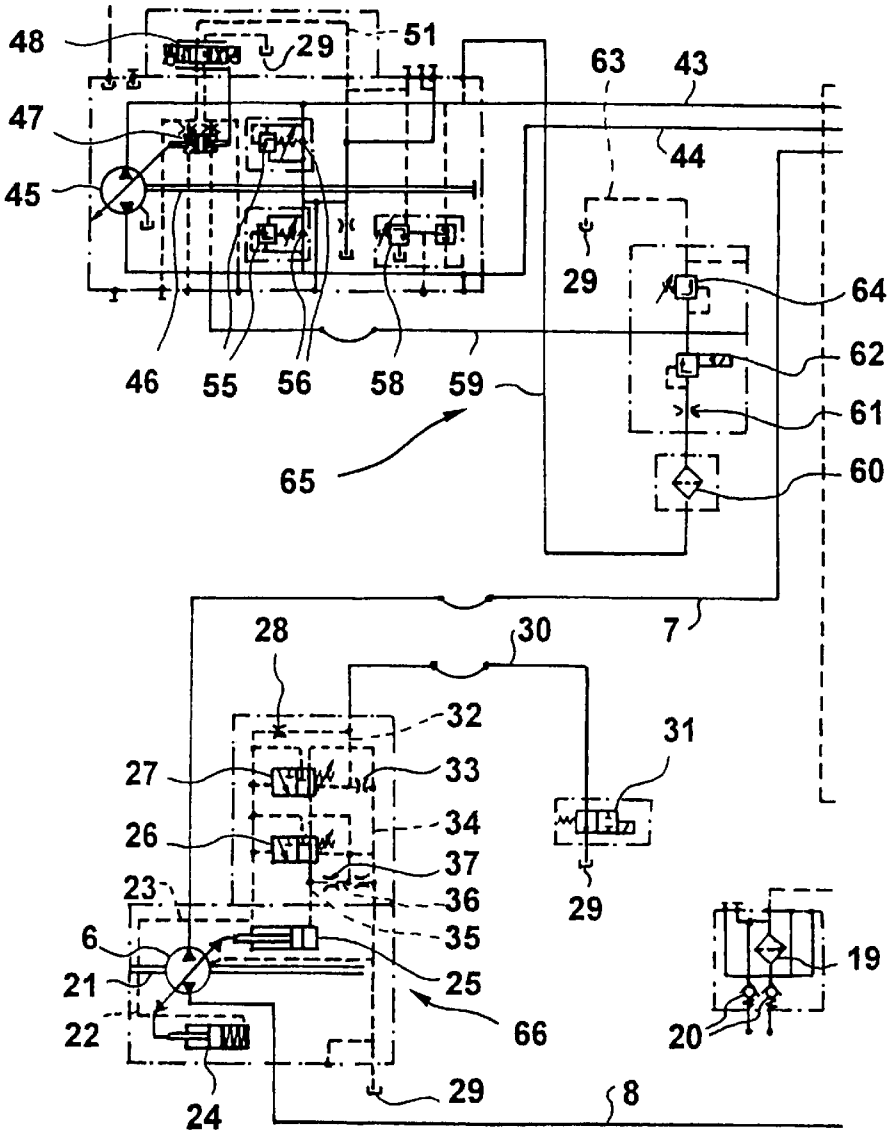
FIG. 2 is an enlarged illustration of the left half of the hydraulic circuit diagram of FIG. 1, separated along separating line II—II in FIG. 1.
Figure 3:
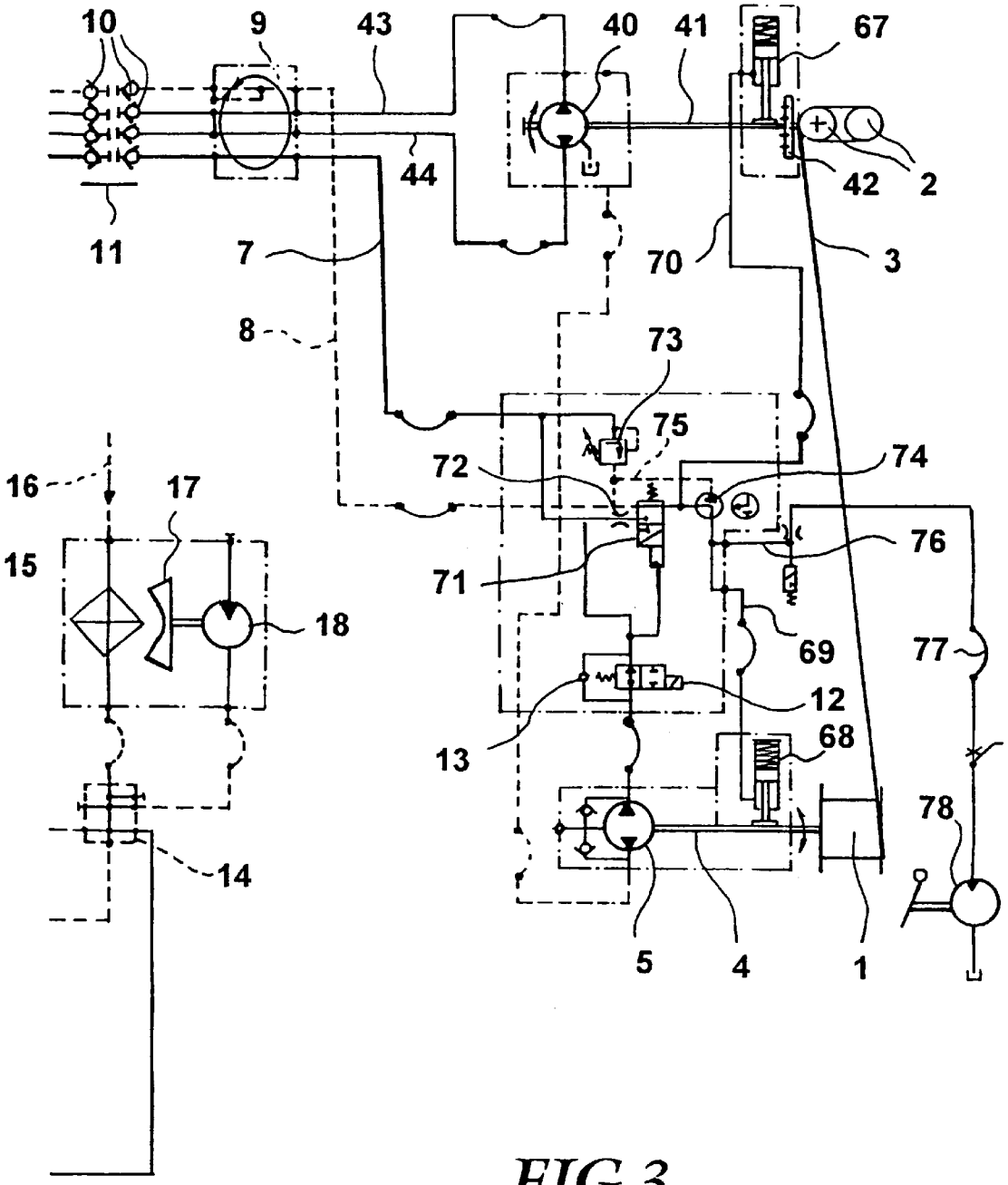
FIG. 3 is an enlarged illustration of the right half of the hydraulic circuit diagram of FIG. 1, separated along separating line II—II in FIG. 1.
Figure 4:
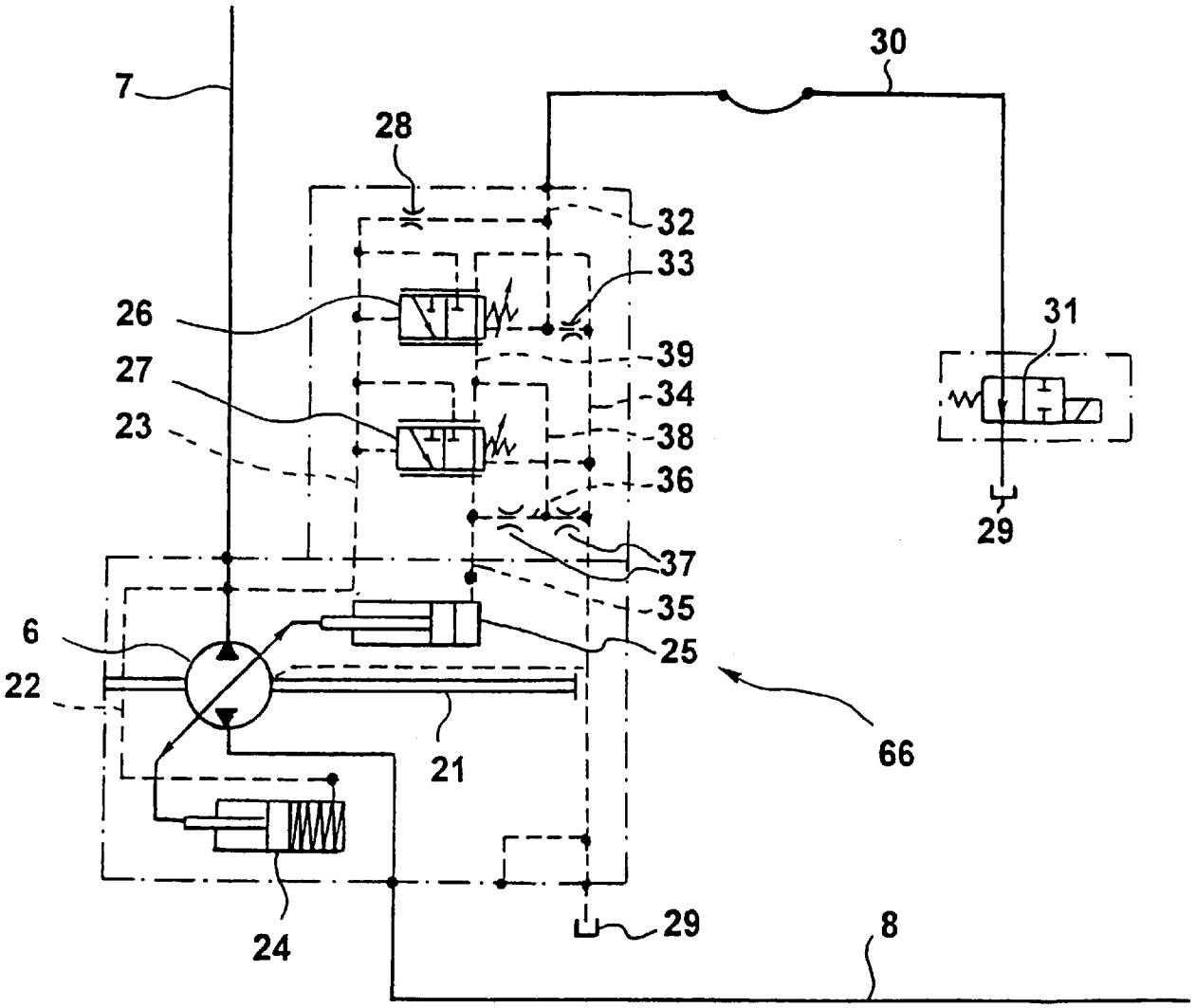
FIG. 4 is an enlarged view of the control circuit shown in FIGS. 1 and 2 for a reel pump.
Figure 5:
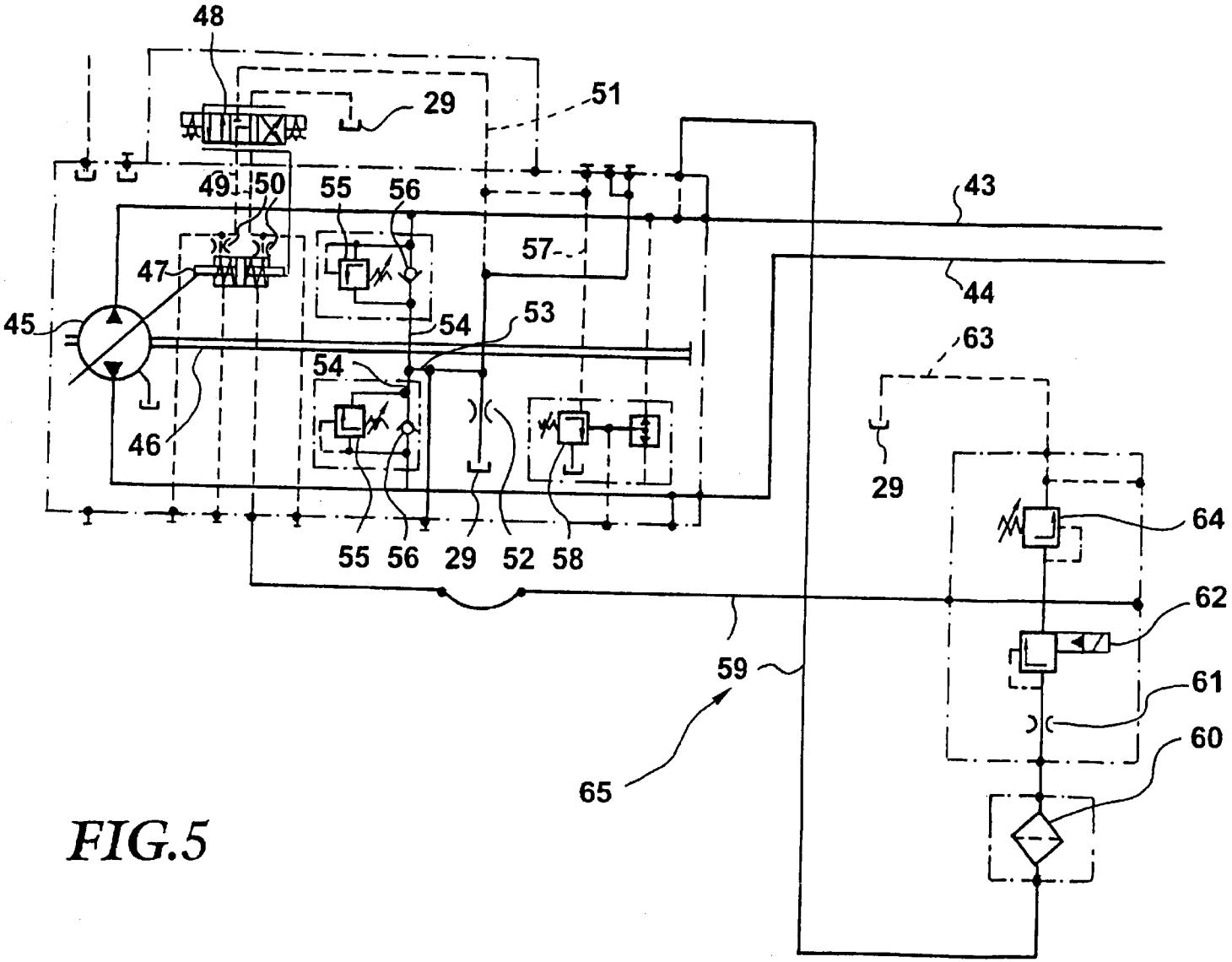
FIG. 5 is an enlarged view of a control circuit shown in FIGS. 1 and 2 for a capstan pump.

The drawing illustrates a hydraulic circuit diagram for a winch of the invention for performing the method of the invention. Such a winch is, for instance, used in piste maintaining devices. When put together along the separating line II—II as drawn in FIG. 1, FIGS. 2 and 3 present an enlarged view of the hydraulic circuit diagram of FIG. 1. Therefore, the following description will apply to the figures on the whole.

DESCRIPTION OF THE PREFERRED EMBODIMENT

The illustrated winch comprises a drum-shaped reel 1 and two capstan heads 2 arranged in parallel and side by side. A rope 3 is wound onto the reel 1 to have a stock thereof, with one end of the rope 3 being tightened from the reel 1 to the capstan heads 2 and being wound around the capstan heads several times. Starting from the capstan head, rope 3 can be attached with a free end to a remote point (not shown).

Reel 1 is connected via a shaft 4 to a reel motor 5, which is designed as a hydraulic motor, and is driven by said motor. The reel motor 5 is a motor having a constant displacement volume. The motor 5 is connected to a reel pump 6 which is designed as a hydraulic pump. The reel pump 6 has two directions of flow and an adjustable displacement volume. Reel motor 5 and reel pump 6 are interconnected via a high-pressure line 7 and a low-pressure line 8 which jointly form a separate hydraulic circuit. The high-pressure line passes through a rotary transmission leadthrough 9 which may, for instance, be implemented by a rotatable extension arm of a piste maintaining device. Next to the rotary transmission leadthrough 9, there are provided two opposite quick-action couplings 10 in the high-pressure line, which couplings are designed as operable springless check valves. They can be opened by a switch (not shown) in both directions, so that the high-pressure line 7 is here connected as a continuous line, as shown by the substitute line 11 drawn adjacent thereto.

A 2/2-port directional control valve 12 which in the illustrated position allows passage in both directions and blocks the line in the other position is shown between the rotary transmission leadthrough 9 and the reel motor 5. The directional control valve is spring-loaded and can be switched in an electromagnetically operated manner against the spring force. The directional control valve 12 is bridged by a check valve 13 which blocks in the direction from the pump 6 to the motor 5 and allows passage in the opposite direction.

The low-pressure line 8 is guided via a manifold 14 also across the quick-action coupling 10 and the rotary transmission leadthrough 9. A cooler 15 into which leakage oil flows via a leakage oil line 16 in a manner which is not illustrated in more detail is connected to the manifold. The cooler is cooled by a fan 17. The fan 17 is driven by a fan motor 18 which is designed as a hydraulic motor with one flow direction and a constant displacement volume. The fan motor 18 is connected to the manifold 14.

Moreover, the manifold 14 has connected thereto a filter 19 with spring-loaded check valves 20 coupled to the filter.

The lines shown in dash-dotted fashion in the drawing respectively encase elements which are jointly found in one constructional unit.

The reel pump 6 is connected to a drive shaft 21 which is driven by a diesel engine (not shown). Near the reel pump 6, two lines 22, 23 are branched off from the high-pressure line 7. The line 22 leads to a single-acting spring-loaded cylinder 24. A pressure spring which presses the cylinder piston out of the cylinder is arranged in the chamber of the cylinder. The cylinder piston serves as an adjusting device of the adjustable reel pump 6. The pressure spring loads the reel pump 6 in a pivoting direction.

Line 22 leads via valves to a single-acting cylinder 25 which also serves as an adjusting device of the reel pump 6 and counteracts cylinder 24. Two 3/2-port directional control valves 26, 27 are branched off in parallel-connected fashion from line 23. A throttle 28 is provided in line 23 behind the place where the valves 26, 27 are branched off. Downstream of the throttle 28, line 23 ends in a tank line 30 which leads to a tank 29. A 2/2-port directional control valve 31 is provided in tank line 30 upstream of the tank 29. In the illustrated position, the valve allows passage to the tank 29. In the other position, the valve blocks the tank line 30. The valve 31 is spring-loaded at one side and electromagnetically adjustable against the action of the spring.

From the meeting point of lines 23, 30, a branch line 32 leads via a throttle 33 to a tank line 34 which leads to a tank 29. Valves 26, 27 are loaded against the action of an adjustable spring by the pressure prevailing in line 23. An outlet port of the valves 26, 27 is connected to a chamber line 35 which is coupled with the piston chamber of cylinder 25. In the illustrated position, the valves 26, 27 are connected to the tank line 34 and the line 23 is shut off. In the respectively other position of the valves 26, 27, the tank line 34 is connected to the chamber line 35 and the tank line 34 is shut off. The valve 26 opens at a pressure of about 20 bar in line 23, while the valve 27 only opens at a pressure of about 130 bar in line 23. These pressures, however, are optionally variable by changing the spring load. A throttle line 36 which ends in tank line 34 is branched off between the valve 27 and the cylinder 25. Two throttles 37 are successively arranged in the throttle line 36. A branch line 38 which is branched off from a connection line 39 of the two valves 26, 27 terminates between the throttles 37.

The two cylinders 24, 25 are dimensionally adapted to each other such that the cylinder 25 can apply a great force against the cylinder 24, so that the reel pump 6 can be pivoted back. This can, for instance, be accomplished by selecting corresponding cross-sectional piston areas.

Leakage oil from the reel pump 6 is discharged via a separate line and the tank line 36 to the tank 29.

The capstan heads 2 are driven by a capstan motor 40 which is designed as a hydraulic motor. The capstan motor 40 has a constant displacement volume and two directions of flow. The capstan heads 2 and the capstan motor 40 are interconnected via a shaft 41 which is geared to the capstan heads 2 via a transmission gear 42. The transmission gear 42 may be a planetary gear.

The capstan motor 40 is connected via a load pressure line 43 and a return line 44 to a capstan pump 45, which is designed as a hydraulic pump, and is driven by the pump. The capstan pump 45 has an adjustable displacement volume and two directions of flow. Preferably, the load pressure during winch operation is always led across the load pressure line 43. The capstan pump 45 is driven by a diesel engine (not shown) via a drive shaft 46. The drive shaft 46 and the drive shaft 21 may be designed as one shaft by which the capstan pump 45 and the reel pump 6 are driven.

The displacement volume of the capstan pump 45 is adjusted by a double-acting cylinder 47 which is spring-loaded at two sides and has a two-sided piston rod. The cylinder 47 serves as an adjustment actuator of the capstan pump 45.

The cylinder 47 is operated via a 4/3-port directional control valve 48 of which one respective port is connected to a piston chamber of cylinder 47. The valve 48 is spring-loaded at both sides and adjustable from both sides in an electromagnetically operated manner. Without any electromagnetic actuation, it is held in the center position as shown in the drawing. In this position, the two piston chambers are connected to a tank 29 in currentless fashion, so that the cylinder 47 in the center position as drawn is exclusively held by the springs.

A respective throttle 50 is provided in both lines 49 leading from the cylinder 47 to the valve 48, with one throttle having a smaller passage cross-section than the other one. Of the ports of the valve 48 which are opposite to the cylinder 47, one port directly leads into a tank 29. The other port leads via a pressure line 51 across a throttle 52 to a tank 29. An intermediate line 53 is branched off in front of throttle 52. The intermediate line 53 branches into two arms 54, of which one respectively connects the intermediate line 53 to the load pressure line 43 and to the return line 44, respectively. Each of the arms 54 has provided therein a pressure control valve 55 which allows passage towards the intermediate line 53 and which has connected in parallel therewith a check valve 56. The check valve 56 blocks passage from the load pressure line 43 and the return line 44, respectively, to the intermediate line 53. This arrangement in the two arms 54 ensures that the pressure difference between the load pressure line 43 and the return line 44 above a specific pressure amount is respectively led via the intermediate line 51 and the pressure line 51 to one of the ports of valve 48. In the center position of valve 48, which is shown in the drawing, the pressure line 51 is shut off. In the switching variants illustrated next thereto, the pressure line 51 is connected to one of the piston chambers of the cylinder 47 while the other line is connected in pressureless fashion to the tank 29.

A line 57 is branched off from the pressure line 51 to a pressure control valve 58 which terminates in a tank 29 and guarantees an effective pressure in the pressure line 51 at a specific pressure difference.

A control line 59 which is connected to a piston chamber of the cylinder 47 is branched off from the load pressure line 43. A filter 60, a throttle 61 and a proportional valve 62 are successively arranged in control line 59. The valve 62 can be adjusted hydraulically and/or electrically against the pressure prevailing in the control line 59, so that a proportional flow can pass to the piston chamber. The valve 62 can be operated by an operator to control the displacement volume of the capstan pump 45. As a result, the tractive force of the capstan heads 2 can be adjusted in an infinitely variable manner.

A line 63 is branched off between the piston chamber and the proportional valve 62 and guides fluid via a pressure control valve 64 to a tank 29. The circuit with the elements in line 59 forms a control circuit 65. The control means of the reel pump 6 with the elements for operating the cylinders 24, 25 forms a control circuit 66 in a corresponding manner.

A capstan brake 67 is provided on the shaft 41 between the capstan motor 40 and the gear 42. The capstan brake 67 is illustrated as a hydraulic cylinder which is spring-loaded in the direction of extension so that the brake 67 blocks the shaft 41. By analogy, a reel brake 68 is provided between the reel motor 5 and the reel 1 with respect to the shaft 4. The reel brake 68 is also illustrated as a spring-loaded hydraulic cylinder. The piston is spring-loaded in the direction of extension, so that the shaft 4 is blocked. The spring-loaded brakes 67, 68, which are illustrated in the drawing as hydraulic cylinders, may be designed as multiple disk brakes which are spring-loaded in the closing direction of the brake. The respective spring serves as an energy accumulator which upon release of the brakes is subjected to a hydraulic force and supplies this force again as a spring force for locking the brake upon reduction of the hydraulic force.

The chamber of the cylinder of the reel brake 68 which is opposite to the spring is connected to a reel brake line 69. By analogy, the chamber of the capstan brake 67 which is opposite to the spring is connected to a capstan brake line 70. The lines 69 terminate in a joint line which is connectable via a 3/2-port directional control valve 71 to the high-pressure line. The valve 71 can be adjusted with the aid of the pressure of the high-pressure line against a spring force. In the position shown in the drawing, the lines 69 and 70 are connected to the low-pressure line 8 while the port of the high-pressure line 7 is blocked. When a switching pressure in the high-pressure line of, for instance, about 100 bar is exceeded, the valve 71 is automatically adjusted, so that the lines 69, 70 are connected to the high-pressure line 7 and the connection of the low-pressure line 8 is blocked. A throttle 72 is provided in the connection of the high-pressure line 7 to the valve 71.

The connection of the low-pressure line 8 to the valve 71 is separately connected via a pressure control valve 73 to the high-pressure line 7. At a pressure of about 190 bar in the high-pressure line 7, valve 73 allows passage, thereby preventing an overload of the reel motor 5 above a permissible pressure value.

A rotatable switching valve 74 is provided in the reel brake line 69 between the capstan brake 67 and the meeting point with the capstan brake line 70. Two positions of the switching valve 74 are shown in the drawing. The position which is shown in the brake line 69 provides for a free passage through the brake line 69. In the position drawn next thereto, the reel brake line 69 is blocked off from the lines 7, 8. The passage port of the valve 71 is connected via a line 75 to the low-pressure line 8.

An external connection 76 to which a minimeasuring line 77 with a hand-operated hydraulic pump 78 can be connected is branched off from the line 69 between the switching valve 74 and the reel brake 68. A connection to a spring-loaded pressure switch with a limit pressure of about 20 bar is branched off from the external connection 76 in parallel therewith.

The function and operation of the embodiment of the invention as shown in the drawing shall now be explained in more detail in the following:

As a rule, the drive circuit of the hydraulic system for the reel and the drive circuit of the hydraulic system for the capstan heads are independent of one another. The drive of the capstan heads can be controlled separately via the control circuit 65. The drive of the reel can be adjusted via the control circuit 66 and the valve 12.

When the winch is used in a piste maintaining device, the winch is switched off when the vehicle is at a standstill. The reel brake 68 and the capstan brake 67 are hydraulically relieved, so that the shafts 4, 41 are locked due to the spring load of the brakes. The valve 31 is without current. When the vehicle is started, the reel pump 6 is driven by a diesel engine. The pump is entirely pivoted outwards due to the spring load of cylinder 24. A standby pressure of 20 bar is obtained through the valve 26 which opens at 20 bar. In this case, however, no fluid will flow across the high-pressure line 7. The connection to the tank 29 is blocked by adjusting the valve 31, so that the pressure will rise. The valve 27 opens at about 120 bar. Pressure is here applied to the cylinder 25 which acts against the cylinder 24 to reset the reel pump 6 accordingly. The dimensional ratios of the pistons are chosen accordingly, so that in comparison with the cylinder 24 a slightly higher restoring force is possible via the cylinder 25. An approximately constant pressure is set in the high-pressure line 7 thanks to this arrangement. When the valve 31 is switched in, and the pressure rises up to said pressure, the valve 71 will open at a switching pressure of about 100 bar, so that the brakes 67, 68 are released against the force of the spring and the shafts 41, 4 are permitted to rotate. Capstan drive and capstan brake can now start their operation. Hence, the reel motor 5 will only become effective when the reel brake 68 has been released, so that the reel 1 will only be rotated when the reel motor 5 provides enough torque for the necessary rope tension.

The control circuit 66 ensures that the displacement volume of the reel pump is adapted such that enough tension is always produced on the reel, but that the tension does not exceed an admissible maximum value. About 700 N are here intended as the tractive force between capstan head 2 and reel 1. This amount, however, can be adjusted to the desired value by varying the parameters of the reel drive.

When the tractive force in the rope 3 decreases or when the rope between capstan head and reel becomes slack, the reel motor 5 can rotate at a faster pace and the pressure in the high-pressure line 7 threatens to decrease, thereby having an effect on the control circuit 66. As a consequence, the cylinder 25 is slightly retracted, so that the pump will pivot to a greater degree and provide more drive force for the reel motor 5.

When the rope tension threatens to exceed the admissible value, this will have an effect on the control circuit 66 through an increased pressure across the high-pressure line 7, with the control circuit 66 extending the cylinder 25 to a slightly greater degree, so that the reel pump 6 is reset. Hence, there is always an optimum tensile force which is made possible by adjusting and controlling the reel 1.

In the opened state of the capstan brake 67, the capstan drive can be controlled separately via the control circuit 65, and the advance force of the rope can thus be controlled. Starting from the pressureless center position, the drive direction can be chosen by adjusting the valve 48 to the left or to the right. As a result, one of the chambers of the cylinder 47 is subjected to pressure via the pressure line 51, so that the adjusting pump is pivoted outwards and the capstan motor 50 is driven. By adjusting the valve 62, this can be counteracted by a counterpressure applied into the respectively other chamber of the cylinder 47, so that the capstan pump 45 is pivoted back to the desired value. The valve 62 can, for instance, be adjusted accordingly by an operator through a potentiometer.

Hence, during operation the drive of the capstan head 2 can be controlled correspondingly, with the reel automatically maintaining an optimum rope tension which is adapted to the advance movement, so that the rope can be wound in a well-ordered manner and an adequate static friction is available when the rope is wound around the capstan head. The reel 1 is automatically controlled in a hydraulic circuit which is independent of the capstan drive. Nevertheless, it is always adapted to the capstan drive in an optimum manner. This has also the advantage that in comparison with the prior art the reel drive operates without loss.

When the rope is wound onto the reel and is to be fixed at a remote fixing place as a counter-support, the rope must first be unwound from the reel. To this end, current is applied to the valve 12, so that it will block passage. The rope will wind around the capstan heads by slightly pulling the free end of the rope, which is sufficient for the static friction for pushing the rope out. When the capstan heads 2 are driven, the reel motor 5 serves as a pump and feeds into the high-pressure line 7 of the pump via the check valve 13. Rope is here unwound from the reel; however, even during unwinding a desired tractive force of about 700 N can be observed again in the rope between reel 1 and capstan head 2. The hydraulic motor operates against the operative pressure prevailing in the high-pressure line 7.

When the rope is being unwound, a frictional grip of the rope on the capstan heads 2 can only be observed in cases where the free rope end is slightly pulled. Such a pull occurs under a load of about 5 to 10 kg. In such a case there is a sufficient winding around the capstan heads 2. When no force is applied at the free end, the capstan heads 2 will spin relative to the rope, so that the capstan heads will not produce any advance movement for unwinding. In a preferred embodiment, the rope is free from additional tightening devices at the side of the capstan heads 2 which is opposite to the reel 1. In this case a winding-around will only take place under application of a force when the rope is drawn out.

When the rope must be replaced and a new rope must be arranged on the reel, the vehicle is stopped and the rope is pulled over the capstan heads. In so doing the switching valve 74 is rotated into the position drawn next to the line 69, so that the line 69 is shut off by the valve 71. The minimeasuring line 77 and the hand pump 78 are externally connected to the external connection 76. The reel brake 68 can be released by operating the hand pump and the rope can be arranged by rotating the reel. Thereupon, the mimimeasuring line 77 and the pump 78 are again disassembled. Subsequently, the switching valve 74 is again reset into the former position, so that the rope can be hauled in.

While the rope is being arranged, the capstan brake 67 is relieved towards the tank and locks, so that the capstan heads 2 are blocked for reasons of safety.

Efficiency can be improved with the solution of the invention. Maintaining and adjusting work of reel drive and capstan drive are reduced. The rope is wound onto and unwound from the reel in a well-ordered manner and under a sufficient rope force for a sufficient static friction of the rope on the capstan head 2.

What is now claimed is:

1. A method of operating a winch, in which a rope is wound onto a driven reel is supplied to at least one capstan head and is wound around said capstan head, with a capstan drive rotating said capstan head and producing a rope advance due to the rope friction existing between the rope and capstan head, the reel drive is adjusted separately, next to the capstan drive, wherein a control circuit of the reel drive is activated.

2. The method according to claim 1, wherein the reel is driven in accordance with the necessary tensile force of the rope between reel and capstan head.

3. The method according to claim 1 wherein the displacement volume of a hydraulic pump which is connected to a hydraulic motor driving the reel is adjusted in response to the load state of the hydraulic motor.

4. The method according to claim 1, wherein the load pressure is kept substantially constant under different conditions in a high-pressure line which is provided between a hydraulic motor driving the reel and the hydraulic pump driving the motor.

5. The method according to claim 1, such that when the rope is pulled from the reel a motor of the reel drive is operated as a resistance-producing pump.

6. The method according to claim 1, wherein the capstan drive is controlled independently of the reel drive according to the necessary rope advance.

7. The method according to claim 6, wherein the displacement volume of a hydraulic pump which is connected to a hydraulic motor driving the capstan head is varied with the aid of and under separate control of the load pressure produced by the hydraulic pump.

8. The method according to claim 1, such that a reel brake and a capstan brake are simultaneously released upon start of the winch drive.

9. The method according to claim 8, wherein the brakes are operated in response to an operational pressure in a hydraulic line of the reel drive.

10. The method according to claim 8, wherein the brakes are only released after a torque has been applied to the reel.

11. The method according to claim 1, wherein during the change of the rope on the reel a reel brake is released by actuating means which are separated from the drive.

12. The method according to claim 1, wherein the capstan drive is blocked upon change of the rope.

13. A winch, in particular for performing the method according to claim 1 comprising a reel driven by a reel drive, onto which ropes can be wound and from which ropes can be unwound, said rope being adapted to be fed from the reel to at least one capstan head and being adapted to be wound around said capstan head, and a capstan drive rotating the capstan head and advancing the rope due to rope friction with the capstan head, wherein the reel drive is provided separately next to the capstan drive and is adjustable independently thereof.

14. The winch according to claim 13, wherein the reel and capstan head are hydraulically driven, said reel comprising a driving reel motor having a reel pump of its own and said capstan head comprising a driving capstan motor of its own with a separate capstan pump.

15. The winch according to claim 14, wherein the reel pump is adjustable, with an adjusting device of the pump being motionally coupled with a control circuit which reacts in response to the load condition of the reel motor.

16. The winch according to claim 15, wherein the control circuit can be activated via a switch.

17. The winch according to claim 14, wherein the load pressure is substantially constant in a high-pressure line which is provided between reel pump and reel motor.

18. The winch according to claim 14, wherein the capstan pump is adjustable, with an adjusting actuator of the pump being motionally coupled with a control circuit which can be controlled separately from the outside.

19. The winch according to claim 13, wherein a reel brake and a capstan brake are provided.

20. The winch according to claim 19, such that reel brake and capstan brake are jointly releasable.

21. The winch according to claim 19 wherein said brakes are releasable in response to an operational pressure prevailing in a hydraulic line of the reel drive.

22. The winch according to claim 19, wherein said reel brake is connected to actuating means separated from the drive and is separately releasable.

* * * * *